United States Patent [19]

Lindén

[11] Patent Number: 4,714,159

[45] Date of Patent: Dec. 22, 1987

[54] PACKAGE FOR SCISSORS

[75] Inventor: Olavi Lindén, Björkkulla, Finland

[73] Assignee: Oy Fiskars AB, Helsinki, Finland

[21] Appl. No.: 901,538

[22] Filed: Aug. 28, 1986

[30] Foreign Application Priority Data

Aug. 25, 1985 [FI] Finland ..... 853310

[51] Int. Cl.[4] ..... B65D 73/00; B26B 29/04

[52] U.S. Cl. ..... 206/349; 206/477; 30/151

[58] Field of Search ..... 224/232; 30/151, 155, 30/233.5, 152, 287, 286, 233; 206/45.14, 207, 317, 349, 363, 371, 464, 465

[56] References Cited

U.S. PATENT DOCUMENTS

| | | | |
|---|---|---|---|
| 2,398,764 | 4/1946 | Bailey | 224/232 X |
| 2,684,758 | 7/1954 | Aquino | 206/349 |
| 3,487,922 | 1/1970 | Peck | 206/349 |
| 4,165,805 | 8/1979 | Fethke et al. | 206/349 |

FOREIGN PATENT DOCUMENTS

| | | | |
|---|---|---|---|
| 99521 | 7/1983 | European Pat. Off. . | |
| 2509491 | 9/1976 | Fed. Rep. of Germany | 206/349 |
| 3048328 | 7/1982 | Fed. Rep. of Germany | 206/349 |
| 2435932 | 5/1980 | France | 206/349 |
| 111022 | 6/1944 | Sweden | 224/232 |

*Primary Examiner*—Stephen Marcus
*Assistant Examiner*—T. Graveline
*Attorney, Agent, or Firm*—James E. Nilles

[57] ABSTRACT

The invention relates to a package for scissors, which package comprises a card (1), a case (3) for the blade portion of the scissors, and means (6) for fastening the scissors to the case. In known packages, the fastening means of the scissors are relatively complicated, and the fastening must be carried out manually or by means of a special machine. The fastening of the scissors (4) to the case (3) becomes simpler if the case is provided with snap action means (6) which can engage with a head (5) of the hinge member of the scissors. In order to enable the snap action of the means, the case is formed as a substantially stiff sheath (3) which can be used as a covering for the scissor blades during the later use of the scissors.

3 Claims, 3 Drawing Figures

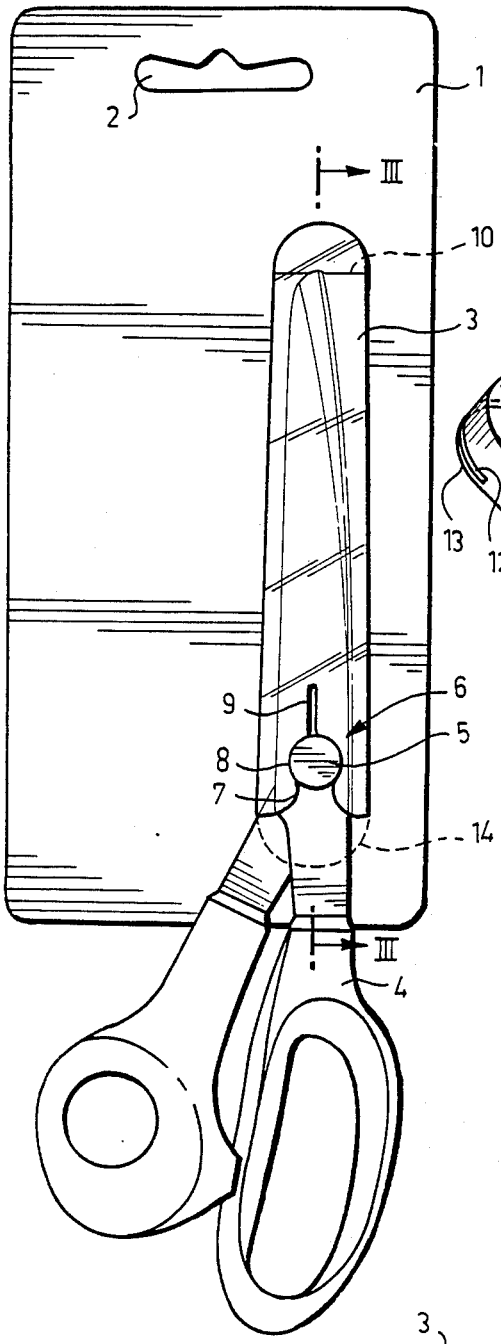
FIG. 1
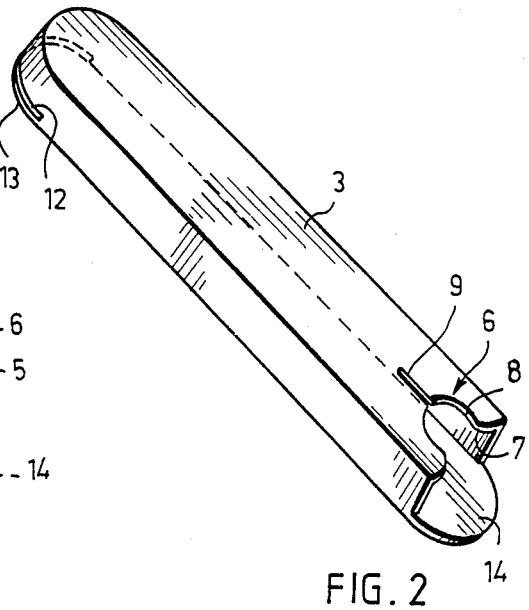
FIG. 2
FIG. 3
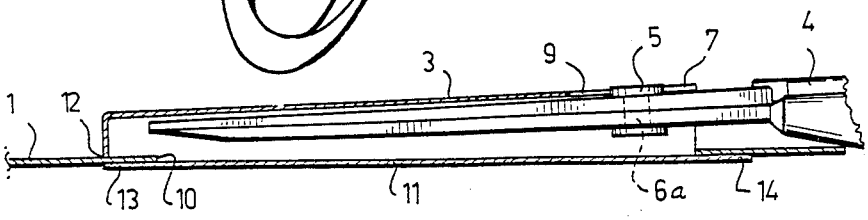

PACKAGE FOR SCISSORS

The present invention relates to a package for scissors, comprising a card, a case intended for the blade portion of the scissors, and said case being formed by a substantially stiff sheath which is fastened to the card, and means for removably fastening the scissors to the package.

Scissors are usually sold in packages of the above type, which packages are provided with an opening for the hanging thereof on a hook in the shop. The case is made of a relatively flexible, transparent plastic material, and it can be fastened to the paperboard card in different ways, e.g. by bending the edges of the case round the edges of the card. Alternatively, the case can be formed as a bag which is open at one end, whereby the card is inserted into the bag.

Different kinds of locking means are used for fastening the scissors to the case and the card, such as pins and thread loops which go through the case and the card and the hole of one handle portion or are positioned between the handle portions of the scissors.

It is common to known packages that the fastening of the scissors to the package is relatively complicated and, accordingly, extensive. Additionally, the packages are so constructed that they cannot be used for any kind of purpose after the package has been opened, wherefore they are thrown away after the scissors has been removed from the package.

The object of the present invention is to provide a package for scissors which enables the scissors to be fastened to the case more rapidly and in a simpler way than in known packages and which can be used later on, too for facilitating the use of the scissors. The package according to the invention is characterized in that the fastening means of the scissors are positioned in the sheath and provided to engage with a head of the hinge member of the scissors by snap action.

Since the package comprises a stiff sheath provided with snap action means for the fastening of the scissors, the scissors can be fastened to the package very rapidly. In fact, the scissors only has to be pushed into the sheath with the blades ahead until the snap action means positioned in the sheath are engaged with the head of the hinge member of the scissors. It is further to be noted that the sheath can also be used later on as a covering for the scissor blades after the scissors have been taken into use, because the case is formed by a stiff sheath, the scissors being fastened only to the sheath by the snap action. This kind of covering is useful e.g. when the scissors are transported in a bag the lining of which could otherwise be damaged by the sharp scissor blades.

The snap action means can be effected in a simple and inexpensive way, if they are positioned at the opening of the sheath and formed by an inwardly enlarging cut made in one of the edges defining the opening of the sheath. The cut thus preferably has such a shape that it comprises an enclosing part which is intended to make contact with the head of the hinge member, and a neck part which connects the enclosing part with the edge defining the opening of the sheath and the width of which is smaller than the diameter of the head of the hinge member. This structure enables the scissors to be fastened to the sheath by the snap action which is obtained when the head of the hinge member is pushed through the neck part into the enclosing part, which is exposed to a strain while making contact with the edges of the head if the enclosing part is so dimensioned that its diameter in the free state thereof is smaller than the diameter of the head.

In order to widen the range within which the diameter of the enclosing part may vary, and in order to prevent crack formation in the wall of the sheath, it is of advantage that the enclosing part communicates with a slit which extends in the longitudinal direction of the sheath and opens in the enclosing part opposite to the neck part.

The package according to the invention will be described in more detail below with reference to the attached drawing, wherein FIG. 1 is a planar view of the package, FIG. 2 is an axonometric view of the sheath, and FIG. 3 is a section of the package along the line III—III in FIG. 1.

The package shown in FIG. 1 comprises a card 1 of paperboard, for instance. The card is at one end thereof provided with an opening 2 for hanging the package on a bar or a hook. The package further includes a case 3 which is fastened to the card. The scissors is indicated by the reference numeral 4. The scissor blades are positioned within the case, while the handle portions are positioned outside of the case below it.

According to the invention the case is formed by a substantially stiff sheath 3 which can be made of e.g. a PVC plastic having a wall thickness of about 1 mm. Similarly to a knife sheath,the sheath 3 surrounds the scissor blades on all sides except in the direction towards the handle portions where the sheath opening is positioned. The scissor blades are thus surrounded by a closed case which is substantially stiff and preferably transparent.

The scissors 4 are fastened to the sheath 3 by means of snap action means 6 positioned in the sheath, which means are engaged with the head 5 of a hinge member 6*a* of the scissors. The hinge member can be conventionally formed by a rivet or a screw.

The snap action means 6 positioned in the sheath 3 comprise a cut formed on the front side the sheath. The cut extends from the edge of the sheath opening towards the closed end of the sheath and has a neck part 7 the width of which is substantially smaller than the diameter of the head 5; an enclosing part 8 which has the shape of a part of a circle and which communicates with the neck part; and a slit 9 which extends towards the closed end of the sheath from the enclosing part in parallel with the longitudinal sides of the sheath. In its free state, the enclosing part 8 has a diameter which is slightly smaller than the diameter of the head 5. It appears from FIG. 2 in particular how the snap action means 6 are formed in the front side surface of the sheath.

For fastening the sheath on the card 1, the card is provided with an elongated opening which has at least the same width as the sheath and the lower edge of which is positioned (FIG. 1) in level with the opening of the sheath 3, while the upper edge is indicated by the reference numeral 10. The sheath is positioned in this opening in such a manner that its back wall is wholly positioned on the back side of the card 1, whereas the other sheath parts are positioned on the front side of the card. A slot 12 is provided in the end wall at the closed end of the sheath, the width of which slot substantially corresponds to the thickness of the card and which extends up to the side walls, whereby the back wall 11 forms a tongue 13 separate from the other side walls.

Correspondingly, a tongue 14 is provided in the back wall at the open end of the sheath, which tongue extends beyond the sheath opening.

The package according to the invention is assembled in the following way. The sheath 3 is inserted into the opening of the card 1 from the back so that the upper edge 10 of the card opening is pushed into the slot 12 to make contact with the bottom of the slot. Since the sheath opening is thereby positioned in level with the lower edge of the card opening, the sheath can be passed through the opening to the front side of the card until the tongue 14 of the sheath makes contact with the back side of the card.

Thereafter the blades of the scissors 4 are inserted into the sheath so that the upper blade makes contact with the inner surface of the front side of the sheath. When the head 5 reaches the sheath opening, it is pressed through the neck part 7, which is thereby enlarged to correspond to the diameter of the head, and further into the enclosing part 8, the edges of which are exposed to a strain while making contact with the edges of the head 5. By virtue of the pressing force exerted by the hinge member on the enclosing part 8, the scissors is fastened to the sheath 3 in the position shown in FIG. 1. The scissors prevent the sheath from being displaced backwards to the back side of the card and the sheath is thereby fastened to the card in every direction.

When the package is opened, the scissor blades are drawn out of the sheath, whereafter the sheath can be removed from the card opening by displacing the open end, in FIG. 3 downwards, to the back side of the card, whereafter the closed end of the sheath can be detached from the card by displacing the sheath in the longitudinal direction thereof.

When the scissors is later on transported and stored, it can be fastened to the sheath in the above-described way, whereby the sheath forms a covering for the blades similarly to a knife sheath.

It is noted that the snap action means 6 may differ in shape from the above-described. They can e.g. be formed without any connection with the edge of the sheath opening, whereby the head 5 snaps in place within said means by means of a movement perpendicular to the plane of the head. The snap action means do not, either, need to be formed by an opening positioned on the front side of the sheath, but they can be formed by a projection provided on the inner surface of the front or back side of the sheath. It is also to be noted that the sheath can be fastened to the card in many different ways.

I claim:

1. A display package for an article of cutlery that comprises an elongated blade portion and a handle portion connected to one end of the blade portion and having a protruding head on one of said portions adjacent to the connection between them, said display package comprising a panel of cardboard or the like and an elongated sheath wherein said blade portion is received, said display package being characterized by:

A. said sheath
- (1) being of substantially stiff material,
- (2) having opposing spaced apart front and rear walls,
- (3) having wall portions connected with said front and rear walls along the length of the sheath to define opposite sides thereof and cooperating with the front and rear walls to define a closed end of the sheath, the opposite end of the sheath being open for lengthwise insertion of said blade portion thereinto;
- (4) the end of said rear wall comprising a pair of tongues,
  - (a) one of which projects endwise beyond the open end of the sheath and
  - (b) the other of which is defined by a slit in the sheath, in the closed end portion thereof, that is adjacent to said rear wall and has its length parallel to the surfaces thereof, and
- (5) one of said walls being formed with a detent portion which is near said open end of the sheath and which is engageable with a snap action with said head as the blade portion is inserted lengthwise into the sheath, to releaseably confine the blade portion against withdrawl from the sheath; and B. said panel having an elongated slot in which said sheath is closely receivable with
- (1) said tongues overlying one surface of the panel adjacent to opposite ends of the slot,
- (2) said front wall spaced beyond the opposite surface of the panel, and
- (3) said handle portion overlying said opposite surface of the panel to cooperate with the tongues in confining the sheath against displacement out of said slot.

2. The display package of claim 1, wherein said front wall has an edge at said opposite end of the sheath, further characterized in that said detent portion is defined by a cutout in said front wall that has a wide portion spaced from said edge wherein said head is receiveable with a close fit and has a narrower portion opening from said wide portion to said edge.

3. The display package of claim 2, further characterized in that a portion of said cutout is in the form of a slit in said front wall that opens from said wide portion of the cutout and extends in the direction lengthwise of the sheath and away from said edge, to provide for flexing of portions of the front wall that are laterally adjacent to the cutout.

* * * * *